United States Patent [19]

Weber

[11] Patent Number: 4,520,792

[45] Date of Patent: Jun. 4, 1985

[54] GRATE BARS FOR USE IN THE GRATES OF INDUSTRIAL FURNACES AND THE LIKE

[75] Inventor: Erich Weber, Munich, Fed. Rep. of Germany

[73] Assignee: Martin GmbH für Umwelt- und Energietechnik, Munich, Fed. Rep. of Germany

[21] Appl. No.: 643,284

[22] Filed: Aug. 22, 1984

[30] Foreign Application Priority Data

Aug. 24, 1983 [DE] Fed. Rep. of Germany ..... 3330637

[51] Int. Cl.[3] ..... F23H 7/08

[52] U.S. Cl. ..... 126/175; 110/281; 126/152 B; 126/167; 198/773

[58] Field of Search ..... 110/281, 282, 283, 328, 110/278; 126/152 R, 152 B, 174, 175, 167; 198/773, 774, 775

[56] References Cited

U.S. PATENT DOCUMENTS

| | | | |
|---|---|---|---|
| 1,553,587 | 9/1925 | Balmfirth | 126/167 X |
| 2,806,439 | 9/1957 | Wagner | 126/175 X |
| 4,450,952 | 5/1984 | Steiner | 110/328 X |

*Primary Examiner*—Edward G. Favors
*Attorney, Agent, or Firm*—Peter K. Kontler

[57] ABSTRACT

A grate for use in industrial furnaces wherein rows of elongated grate bars partially overlap each other and the grate bars of each row include neighboring stationary and longitudinally movable grate bars. The undersides of the marginal zones of neighboring grate bars are undulate by exhibiting alternating teeth and tooth spaces which ensures rapid expulsion of solid particles which happen to penetrate between the lateral surfaces of neighboring grate bars when the movable grate bars reciprocate relative to the adjacent grate bars. The flanks of teeth at the undersides of the marginal zones make with the upper sides of the respective grate bars acute angles of between 20 and 50 degrees, and the thickness of each marginal zone above the deepmost portion of a tooth space is a small fraction of the thickness of the marginal zone above the top land of a tooth. The lateral surfaces of neighboring marginal zones define cutting edges which comminute the solid particles while the particles are in the process of descending toward the nearest tooth spaces so that they can leave the grate by gravity.

16 Claims, 3 Drawing Figures

GRATE BARS FOR USE IN THE GRATES OF INDUSTRIAL FURNACES AND THE LIKE

BACKGROUND OF THE INVENTION

The present invention relates to improvements in grates for use in industrial furnaces or the like, and more particularly to improvements in grate bars which can be utilized in such grates. Still more particularly, the invention relates to improvements in grates of the type wherein the grate bars form rows or tiers of partly overlapping grate bars and at least some of the grate bars are movable longitudinally of the neighboring grate bars. Such grates are disclosed, for example, in U.S. Pat. Nos. 4,235,172, 4,240,402, 4,239,029 and 4,096,809 to which reference may be had, if necessary.

It is already known to utilize in a grate of the above outlined character elongated grate bars whose lateral surfaces are adjacent to or contact each other and which have marginal zones adjacent to the respective lateral surfaces and located outwardly of the downwardly extending ribs which are provided at the undersides of the fuel- and cinder-carrying top sections of the grate bars.

When the mobile grate bars of the grate perform a stirring action, relatively hard or very hard particles (especially particles of metal) are likely to penetrate into the clearances between the lateral surfaces of neighboring grate bars. Such particles are likely to jam and thereby increase the width of clearances between the respective grate bars with a host of undesirable consequences. Thus, the clearances of increased width allow larger quantities of so-called lower wind to penetrate from the underside of the grate into the layer of fuel on the grate to cause uneven combustion and uneven heating of the grate. This entails uneven cooling of the grate bars, especially of those grate bars which are hollow in order to establish paths for forced circulation of a cooling medium. Overheating of grate bars shortens their useful life and causes more pronounced wear. Still, further, a piece of metallic material, cinder or the like which has penetrated between the lateral surfaces of two neighboring grate bars is likely to prevent such grate bars from moving relative to each other which affects the quality of the heating operation and can result in serious damage to grate bars as well as to the equipment which imparts motion thereto.

OBJECTS AND SUMMARY OF THE INVENTION

An object of the invention is to provide a novel and improved grate wherein the likelihood of longer-lasting retention of solid particles between the lateral surfaces of neighboring grate bars is reduced or eliminated in a simple but efficient way.

Another object of the invention is to provide a grate wherein any foreign matter which happens to penetrate between the lateral surfaces of neighboring relatively movable grate bars is expelled immediately or within a surprisingly short interval of time.

A further object of the invention is to provide a grate bar wherein the likelihood of jamming of mobile grate bars is reduced in a novel and improved way.

An additional object of the invention is to provide a grate wherein those portions of grate bars which are adjacent to their lateral surfaces are configurated in a novel and improved way with a view to reduce the likelihood of jamming of mobile grate bars and/or of retention of solid matter between the lateral surfaces.

Still another object of the invention is to provide a grate which can be used with advantage in existing industrial furnaces as a superior substitute for heretofore known grates.

An additional object of the invention is to provide a grate wherein penetration of solid matter between the lateral surfaces of neighboring grate bars does not adversely influence the cooling of grate bars and/or the rate of flow of lower wind from the underside of the grate into the area above the upper sides of the grate bars.

A further object of the invention is to provide a novel and improved method of prolonging the useful life of relatively movable grate bars in a grate for industrial furnaces or the like.

Another object of the invention is to provide a novel and improved grate bar which can be used in a grate of the above outlined character.

One feature of the invention resides in the provision of a grate, particularly for use in industrial furnaces wherein successive rows of relatively movable grate bars partially overlap each other. The grate comprises a pair of neighboring elongated grate bars at least one of which is movable longitudinally with reference to the other grate bar. The grate bars have adjacent marginal zones including serrated undersides having alternating teeth and tooth spaces, as considered in the longitudinal direction of the respective grate bars. Each grate bar further comprises a top section having an upper side, an underside and a lateral surface adjacent to the other grate bar, and at least one rib extending downwardly from the underside of the top section and being spaced apart from the lateral surface. The marginal zones are disposed between the lateral surfaces and the ribs of the respective grate bars and constitute integral parts of the respective top sections. The alternating teeth and tooth spaces need not necessarily extend along the full length of each grate bar; for example, such teeth and tooth spaces can extend along those (selected) portions of the grate bars which are not continuously overlapped by the grate bars of the neighboring row or rows of grate bars.

The teeth of one of the marginal zones are preferably staggered with reference to the teeth of the other marginal zone, at least in one position of the one grate bar with reference to the other grate bar. It is presently preferred to configurate the marginal zones and to mount the grate bars in such a way that the teeth of the two marginal zones are staggered with reference to each other by distances equaling of approximating half the distance between the top lands of two neighboring teeth on a marginal zone. The one grate bar is reciprocable with reference to the other grate bar between first and second end positions and through a predetermined distance which is preferably half the distance between the top lands of two neighboring teeth on a marginal zone.

The angles between the planes of flanks on the teeth of the marginal zones and the planes of the upper sides of the respective top sections are preferably between 20 and 50 degrees, most preferably about 35 degrees. The distance between the deepmost portion of a tooth space and the upper side of the respective top section is preferably a small fraction of the distance between the top land of a tooth and the upper side of the respective top section; for example, the first distance can be between one third and one fourth of the second distance.

Another feature of the invention resides in the provision of an elongated longitudinally movable grate bar for use in the grates of industrial furnaces or the like. The grate bar comprises a top section having an upper side, a longitudinally extending lateral surface and an underside, and at least one rib extending downwardly from the underside of the top section and being spaced apart from the lateral surface. That portion of the underside of the top section which is disposed between the rib and the lateral surface has an undulate shape with alternating hills and valleys or teeth and tooth spaces, as considered in the longitudinal direction of the grate bar. As stated above, the flanks of teeth at the underside of the top section and the upper side of the top section preferably make angles of between 20 and 50 degrees, most preferably angles of approximately 35 degrees. As also mentioned above, the distance between the deepmost portion of any tooth space and the upper side of the top section is preferably a small fraction (preferably between one third and one fourth) of the distance between the top land of any of the teeth and the upper side of the top section of the grate bar.

The novel features which are considered as characteristic of the invention are set forth in particular in the appended claims. The improved grate itself, however, both as to its construction and the mode of assembling its grate bars, together with additional features and advantages thereof, will be best understood upon perusal of the following detailed description of certain specific embodiments with reference to the accompanying drawing.

DESCRIPTION OF THE PREFERRED EMBODIMENTS

Figure 1:
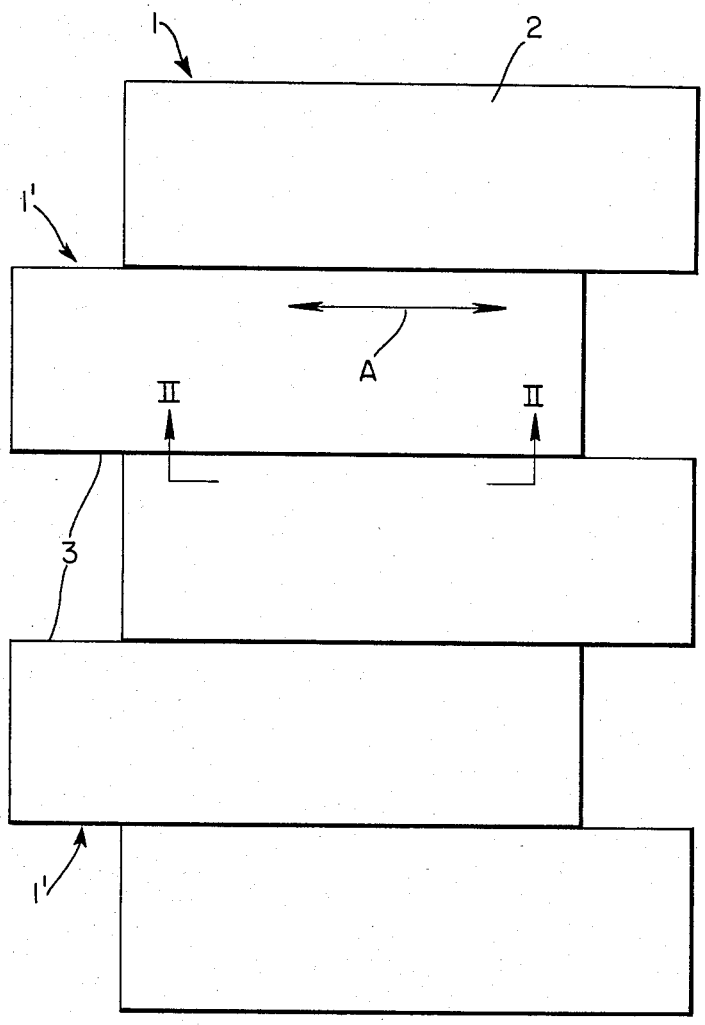
FIG. 1 is a schematic plan view of a portion of a grate.

FIG. 1 shows schematically a row of neighboring elongated grate bars at least some of which are reciprocable with reference to the neighboring grate bars 1 in directions indicated by the double-headed arrow A. For example, the extent of movement of mobile grate bars 1' relative to the other grate bars 1 may be such that the mobile grate bars can move between the illustrated foremost positions and rear end positions in which their front and rear ends are flush with the respective ends of the neighboring (stationary) grate bars 1.

Figure 3:
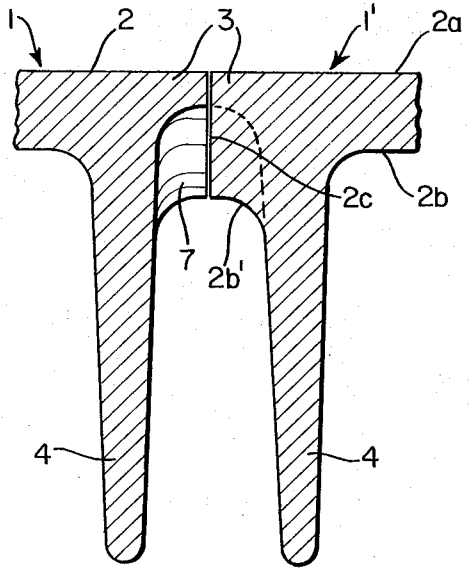
FIG. 3 is a fragmentary transverse vertical sectional view as seen in the direction of arrows from the line III—III of FIG. 2.
Figure 2:
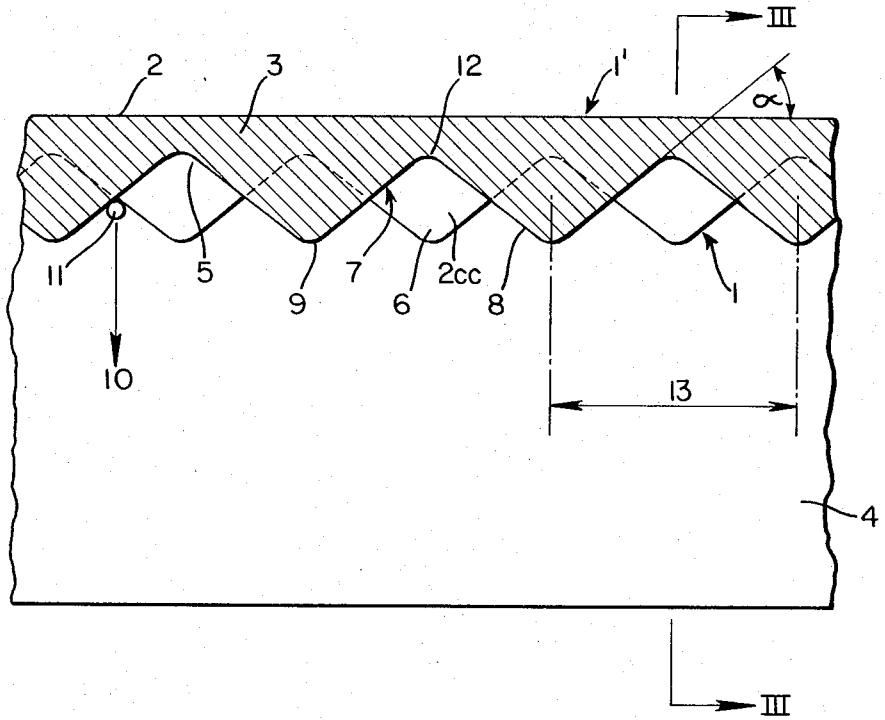
FIG. 2 is an enlarged fragmentary longitudinal vertical sectional view of a grate bar in the grate of FIG. 1 as seen in the direction of arrows from the line II—II.

In accordance with a feature of the invention, those marginal portions or zones 3 of neighboring grate bars 1 and 1' which are immediately adjacent to each other have serrated or undulate undersides *2b'* (see FIG. 3) including alternating hills and valleys or teeth (9) and tooth spaces (5), as considered in the longitudinal direction of the respective grate bars. FIGS. 2 and 3 show that each of the grate bars 1, 1' comprises a plate-like top section 2 having a flat or substantially flat upper side *2a* which supports fuel and/or combustion products, a vertical or nearly vertical lateral surface *2c*, and an underside *2b* which includes the underside *2b'* of the respective marginal zone 3. Each of the grate bars 1, 1' further comprises one or more ribs 4; the illustrated ribs 4 are inwardly spaced from the respective lateral surfaces *2c*, they extend downwardly from the undersides *2b* of the respective top sections 2, and they determine the inner boundaries of the respective marginal zones 3. The ribs 4 can be used to engage coupling devices in a manner as disclosed, for example, in the aforementioned U.S. Pat. No. 4,239,029.

The teeth 9 at the underside *2b'* of one of the marginal zones 3 shown in FIGS. 2 and 3 are staggered relative to the teeth 9 at the underside of the adjacent marginal zone 3, as considered in the longitudinal direction of the grate bars 1 and 1', at least in one position of the mobile grate bar 1' with reference to the neighboring grate bar or grate bars 1. The tooth spaces 5 do not extend all the way to the upper sides *2a* of the respective top sections 2, i.e., these tooth spaces are open only in a downward direction for the purpose of facilitating gravitational descent of any foreign matter (see the solid particle 11 in FIG. 2) as indicated by the arrow 10. These portions of the lateral surfaces *2c* which are provided on the respective teeth 6 are denoted by the reference characters *2cc;* the edges 8 bounding such portions *2cc* of the lateral surfaces *2c* can be said to constitute cutting or shearing edges which bring about rapid comminution of a foreign particle that has penetrated into the space or clearance between two neighboring lateral surfaces *2c* when the grate bars 1' move relative to the grate bars 1. The flanks 7 of the teeth 9 preferably make relatively small acute angles alpha with the planes of the upper sides *2a* of the respective top sections 2; for example, each angle alpha may be in the range of 20–50 degrees, most preferably exactly or close to 35 degrees. Such inclination of the tooth flanks 7 has been found to contribute significantly to the cutting or shearing action of the cutting edges 8 bounding the portions *2cc* of or the entire lateral surfaces *2c* on the top sections 2 of neighboring grate bars.

The distance between the deepmost portions 12 of tooth spaces 5 and the upper sides *2a* of the respective top sections 2 is preferably a small fraction of the distance between such upper sides *2a* and the top lands (actually bottom lands) 6 of the teeth 9. For example, the distance between a top land 6 and the upper side *2a* of the respective top section 2 can be between three and four times the distance between the deepmost portion 12 of a tooth space 5 and the same upper side *2a*. The cutting edges 8 of neighboring lateral surfaces *2c* cooperate to promptly crush or flatten any solid particle 11 which happens to penetrate therebetween or, at the very least, to rapidly advance such particle into one of the tooth spaces 5 so that the particle can descend by gravity in the direction which is indicated by the arrow 10. The extent to which the cutting edges 8 of neighboring lateral surfaces *2c* overlap when the grate bar 1' is in motion varies continuously, and this also contributes to the shearing, crushing, flattening and expelling action of the marginal zones 3 upon the particles 11 between the lateral surfaces *2c* of two neighboring top sections 2. In other words, the volume or capacity of pockets which include pairs of neighboring tooth spaces 5 (one in the marginal zone 3 of a grate bar 1 and the other in the marginal zone 3 of the neighboring grate bar 1') varies continuously as a result of reciprocatory movements of the grate bar 1', and this also contributes to greater tendency of the marginal zones 3 to rapidly induce a foreign particle 11 to leave the clearance between the lateral surfaces 2c and descend to the bottom below the grate.

The reference character 13 denotes in FIG. 2 the distance between the top lands 6 of two neighboring teeth 9 on the marginal zone 3 of the grate bar 1 or 1'. Such distance is preferably approximately twice the length of strokes of the mobile grate bars 1'. In at least one position of the mobile grate bar 1', the relative positions of the two marginal zones 3 are such that the distance 13 is twice or approximately twice the distance between the top land 6 of a tooth 9 on the marginal zone 3 of the grate bar 1 and the top land 6 of the nearest tooth 9 on the marginal zone 3 of the adjacent grate bar 1'. Thus, in the just mentioned position of the mobile grate bar 1' with reference to the adjacent grate bar 1, the pitch (distance 13) of teeth 9 at the serrated undersides 2b' of the two marginal zones 3 is twice the extent to which the teeth 9 of the two marginal zones 3 are staggered relative to each other, as considered in the longitudinal direction of the grate bars. The arrangement may be such that the teeth 9 of the marginal zone 3 of the mobile grate bar 1' register with the teeth 9 of the other marginal zone 3 when the mobile grate bar 1' assumes its rear end position.

It is not necessary to provide teeth and tooth spaces along the full length of each marginal zone 3. For example, it is sufficient (at least in many instances) if the teeth 9 and tooth spaces 5 are provided on and in those portions of the undersides 2b' where the grate bars 1 and 1' of FIGS. 2 and 3 are not continuously overlapped by the grate bars in the adjoining row or row of the grate.

An important advantage of the improved grate and its grate bars is the ability of such parts to expel foreign matter with surprising ease and within surprisingly short intervals of time. The marginal zones 3 of neighboring grate bars 1 and 1' act not unlike the cooperating blades of a mower cutter bar by rapidly and predictably comminuting, flattening and/or expelling a foreign particle 11 into the nearest tooth space or spaces 5 for gravitational descent to a level below the undersides 2b' of the marginal zones 3. The inclination of flanks 7 relative to the upper sides 2a of the respective top sections 2 entails the development of forces which tend to move solid particles between the lateral surfaces 2c downwardly and out of the clearance between the marginal zones 3. The entrapped solid particles which are in the process of moving downwardly immediately enter the nearest tooth spaces 5 as soon as they descend to the level of such tooth spaces whereby the lateral stressing of solid particles is terminated and the particles are free to leave the grate by gravity. As mentioned above, the selection of angles alpha between 20 and 50 degrees, preferably approximately 35 degrees, has been found to further enhance the solids-expelling action of the marginal zones 3 when the grate bar 1' is in motion. The aforediscussed selection of the extent to which the teeth 9 on one of the marginal zones 3 are staggered relative to the teeth 9 on the other marginal zone also contributes to a more satisfactory and more predictable comminuting, flattening and/or expelling action of the marginal zones 3. The dimensions of pockets or niches which are defined by neighboring tooth spaces 5 of the two marginal zones 3 reach a maximum value when the teeth 9 of one marginal zone register with the teeth of the other marginal zone, i.e., when the mobile grate bar 1' assumes one of its end positions with reference to the stationary grate bar 1. It is evident that the improved marginal portions are just as effective if they are provided on grate bars each of which moves relative to the neighboring grate bar or if the invention is embodied in grates wherein the grate bars 1 move jointly back and forth and the grate bars 1' move with as well as relative to the moving grate bars 1.

The feature that the distance 13 is twice the maximum stroke of the mobile grate bar 1' and that the teeth 9 on one of the marginal zones 3 register with the teeth 5 of the other marginal zone in one end position of the mobile grate bar 1' is desirable and advantageous because this ensures more or less uniform wear upon the entire cutting edges 8 and full utilization of each and every portion of each of these cutting edges. Moreover, this invariably ensures that each and every solid particle which happens to penetrate between the neighboring lateral surfaces 2c is invariably entrained and moved downwardly when the grate bar 1' is in motion.

The feature that the distance between the deepmost portions 12 of the tooth spaces 5 and the upper sides 2a of the respective top sections 2 is a small fraction (normally between one third and one fourth) of the distance between the top land 6 of a tooth 9 and the upper side 2a is also desirable and advantageous because this ensures that a foreign particle 11 which has barely entered the clearance between two neighboring lateral surfaces 2c is compelled to reach the nearest tooth space or tooth spaces 5 after a relatively short downward movement from the upper sides 2a of the corresponding top sections 2.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A grate, particularly for use in industrial furnaces, comprising a pair of neighboring elongated grate bars at least one of which is movable longitudinally with reference to the other grate bar, said grate bars having adjacent marginal zones including serrated undersides having alternating teeth and tooth spaces, as considered in the longitudinal direction of the respective grate bars.

2. The grate of claim 1, wherein each of said grate bars further comprises a top section having a lateral surface adjacent to the other grate bar, and at least one rib extending downwardly from said top section and being spaced apart from said lateral surface, said marginal zones being disposed between the lateral surfaces and the ribs of the respective grate bars and constituting integral parts of the respective top sections.

3. The grate of claim 2, wherein said alternating teeth and tooth spaces are provided in and on selected portions of the respective marginal zones.

4. The grate of claim 2, wherein the teeth of one of said marginal zones are staggered with reference to the teeth of the other of said marginal zones, at least in one position of said one grate bar with reference to said other grate bar.

5. The grate of claim 4, wherein the teeth of said one marginal zone are staggered with reference to the teeth of said other marginal zone by half the distance between the top lands of two neighboring teeth on a marginal zone.

6. The grate of claim 2, wherein said one grate bar is reciprocable with reference to said other grate bar through a predetermined distance between front and rear end positions, the distance between the top lands of two neighboring teeth on each of said marginal zones being equal to or approximating 2d wherein d is said predetermined distance.

7. The grate of claim 2, wherein said top sections have upper sides and said teeth have flanks which make acute angles with the upper sides of the respective top sections.

8. The grate of claim 7, wherein each of said angles is between 20 and 50 degrees.

9. The grate of claim 8, wherein each of said angles is approximately 35 degrees.

10. The grate of claim 2, wherein said top sections have upper sides and the distance between the deepmost portions of said tooth spaces and the respective upper sides is a fraction of the distance between the top lands of said teeth and the respective upper sides.

11. The grate bar of claim 10, wherein the distance between the top lands of said teeth and the respective upper sides is between three and four times the distance between the deepmost portions of said tooth spaces and the respective upper sides.

12. As a novel article of manufacture, an elongated longitudinally movable grate bar for use in the grates of industrial furnaces or the like, comprising a top section including a longitudinally extending lateral surface and having an upper side and an underside, and a rib extending from the underside of said top section and being spaced apart from said lateral surface, that portion of the underside of said top section which is disposed between said lateral surface and said rib having an undulate shape with alternating teeth and tooth spaces, as considered in the longitudinal direction of the grate bar.

13. The grate bar of claim 12, wherein said teeth have flanks which make with the upper side of said top section angles of between 20 and 50 degrees.

14. The grate bar of claim 13, wherein each of said angles is approximately 35 degrees.

15. The grate bar of claim 12, wherein the distance between the deepmost portions of said tooth spaces and the upper side of said top section is a fraction of the distance between the top land of any one of said teeth and the upper side of said top section.

16. The grate bar of claim 15, wherein the distance between the top lands of said teeth and the upper side of said top section is between three and four times the distance between the deepmost portions of said tooth spaces and the upper side of said top section.

* * * * *